US006374412B1

(12) United States Patent
Canlas

(10) Patent No.: US 6,374,412 B1
(45) Date of Patent: Apr. 23, 2002

(54) SWIMMING APPAREL

(76) Inventor: Katherine S. Canlas, 3977 Bass La., Lake Oswego, OR (US) 97034

( * ) Notice: Subject to any disclaimer, the term of this patent is extended or adjusted under 35 U.S.C. 154(b) by 0 days.

(21) Appl. No.: 09/770,265

(22) Filed: Jan. 26, 2001

(51) Int. Cl.[7] ..... A41D 7/00
(52) U.S. Cl. ..... 2/67; 2/69
(58) Field of Search ..... 2/67, 69, 406, 2/408, 78.1, 78.3, 73, 80, 83, 75; 450/6–11, 104, 105

(56) References Cited

U.S. PATENT DOCUMENTS

| | | | | | |
|---|---|---|---|---|---|
| 1,097,425 | A | | 5/1914 | Greenwald | |
| 1,311,600 | A | * | 7/1919 | Fiore | 2/80 |
| 1,954,526 | A | | 4/1934 | Holahan | |
| 2,339,341 | A | * | 1/1944 | Landau | 2/78.1 |
| 2,437,989 | A | | 3/1948 | Arizt | |
| 2,472,302 | A | * | 6/1949 | Litt et al. | 2/80 |
| 2,521,020 | A | * | 9/1950 | Prescott | 2/80 |
| 2,851,600 | A | * | 10/1958 | Finn | 2/67 |
| 3,036,574 | A | * | 5/1962 | Jeffrey | 2/67 |
| 3,771,172 | A | * | 11/1973 | Barg | 2/67 |
| D269,220 | S | | 6/1983 | Joseph | |
| 4,815,145 | A | * | 3/1989 | Chow | 2/67 |
| 5,042,092 | A | | 8/1991 | Ewing | |
| 5,561,858 | A | * | 10/1996 | Pirer | 2/67 |
| 5,717,998 | A | * | 2/1998 | Everett et al. | 2/67 |
| 6,035,439 | A | * | 3/2000 | Chin | 2/67 |
| 6,185,741 | B1 | * | 2/2001 | Kehoe | 2/67 |

* cited by examiner

*Primary Examiner*—Gloria M. Hale

(57) ABSTRACT

A swimming apparel for providing more comfort and ease for women especially when going to a bathroom. The swimming apparel includes a one-piece suit having a tank top member, a skirt member, and a panty member which includes an upper front portion and a lower front portion which is detachably attached to the upper front portion; and also includes fastening members for fastening said upper and lower front portions together.

8 Claims, 5 Drawing Sheets

SWIMMING APPAREL

BACKGROUND OF THE INVENTION

1. Field of the Invention

The present invention relates to a convenient wearing apparel and more particularly pertains to a new swimming apparel for providing more comfort and ease for women especially when going to a bathroom.

2. Description of the Prior Art

The use of a convenient wearing apparel is known in the prior art. More specifically, a convenient wearing apparel heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,437,989; 2,339,341; 5,042,092; 1,097,425; 1,954,526; and U.S. Pat. No. Des. 269,220.

While these devices fulfill their respective, particular objectives and requirements, the aforementioned patents do not disclose a new swimming apparel. The inventive device includes a one-piece suit having a tank top member, a skirt member, and a panty member which includes an upper front portion and a lower front portion which is detachably attached to the upper front portion; and also includes fastening members for fastening said upper and lower front portions together.

In these respects, the swimming apparel according to the present invention substantially departs from the conventional concepts and designs of the prior art, and in so doing provides an apparatus primarily developed for the purpose of providing more comfort and ease for women especially when going to a bathroom.

SUMMARY OF THE INVENTION

In view of the foregoing disadvantages inherent in the known types of convenient wearing apparel now present in the prior art, the present invention provides a new swimming apparel construction wherein the same can be utilized for providing more comfort and ease for women especially when going to a bathroom.

The general purpose of the present invention, which will be described subsequently in greater detail, is to provide a new swimming apparel which has many of the advantages of the convenient wearing apparel mentioned heretofore and many novel features that result in a new swimming apparel which is not anticipated, rendered obvious, suggested, or even implied by any of the prior art convenient wearing apparel, either alone or in any combination thereof.

To attain this, the present invention generally comprises a one-piece suit having a tank top member, a skirt member, and a panty member which includes an upper front portion and a lower front portion which is detachably attached to the upper front portion; and also includes fastening members for fastening said upper and lower front portions together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new swimming apparel which has many of the advantages of the convenient wearing apparel mentioned heretofore and many novel features that result in a new swimming apparel which is not anticipated, rendered obvious, suggested, or even implied by any of the prior art convenient wearing apparel, either alone or in any combination thereof.

It is another object of the present invention to provide a new swimming apparel which may be easily and efficiently manufactured and marketed.

It is a further object of the present invention to provide a new swimming apparel which is of a durable and reliable construction.

An even further object of the present invention is to provide a new swimming apparel which is susceptible of a low cost of manufacture with regard to both materials and labor, and which accordingly is then susceptible of low prices of sale to the consuming public, thereby making such swimming apparel economically available to the buying public.

Still yet another object of the present invention is to provide a new swimming apparel which provides in the apparatuses and methods of the prior art some of the advantages thereof, while simultaneously overcoming some of the disadvantages normally associated therewith.

Still another object of the present invention is to provide a new swimming apparel for providing more comfort and ease for women especially when going to a bathroom.

Yet another object of the present invention is to provide a new swimming apparel which includes a one-piece suit having a tank top member, a skirt member, and a panty member which includes an upper front portion and a lower front portion which is detachably attached to the upper front portion; and also includes fastening members for fastening said upper and lower front portions together.

Still yet another object of the present invention is to provide a new swimming apparel that is easy and convenient to use.

Even still another object of the present invention is to provide a new swimming apparel that avoids the user having to remove the entire one-piece suit when going to the restroom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
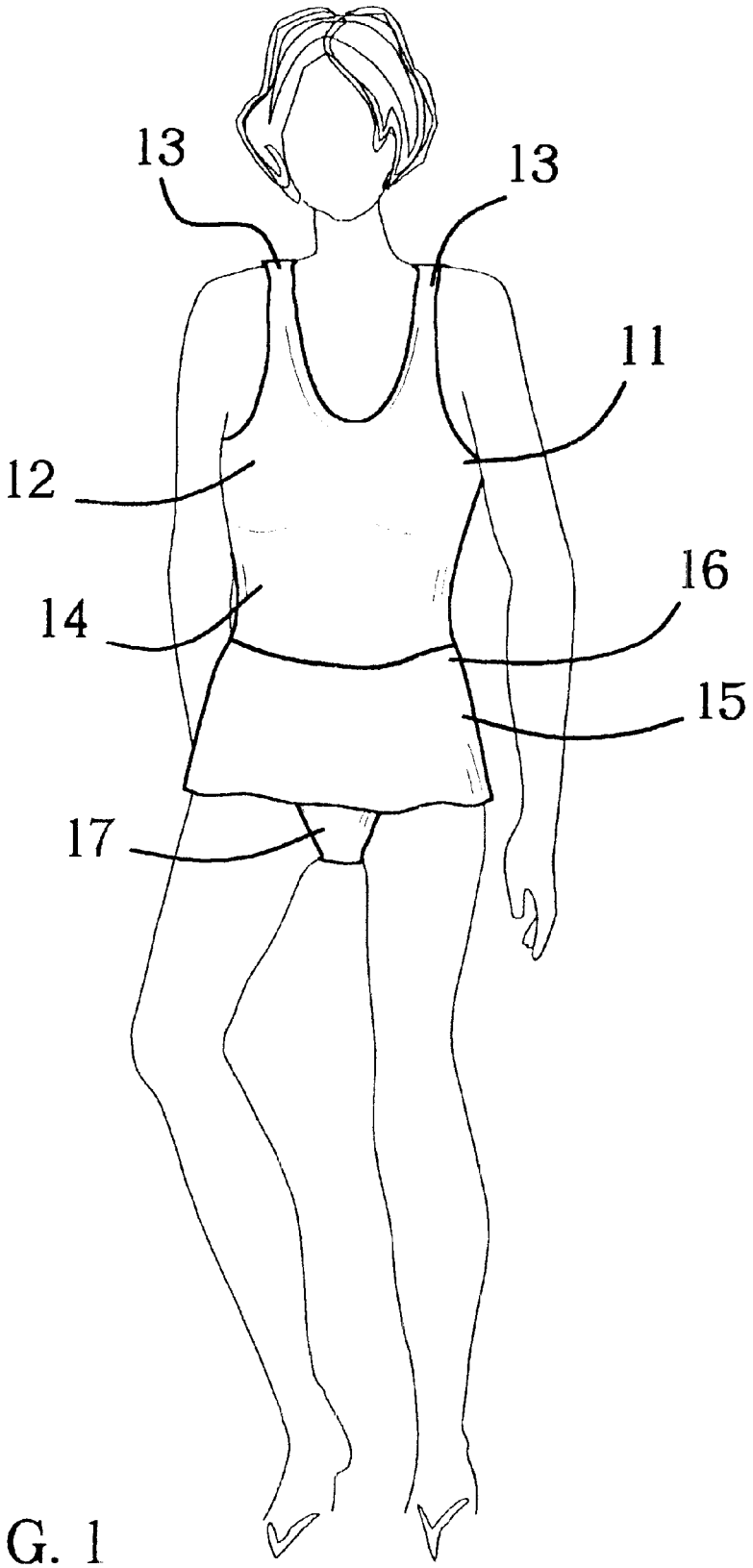
FIG. 1 is a perspective view of a new swimming apparel according to the present invention and shown in use.
Figure 2:
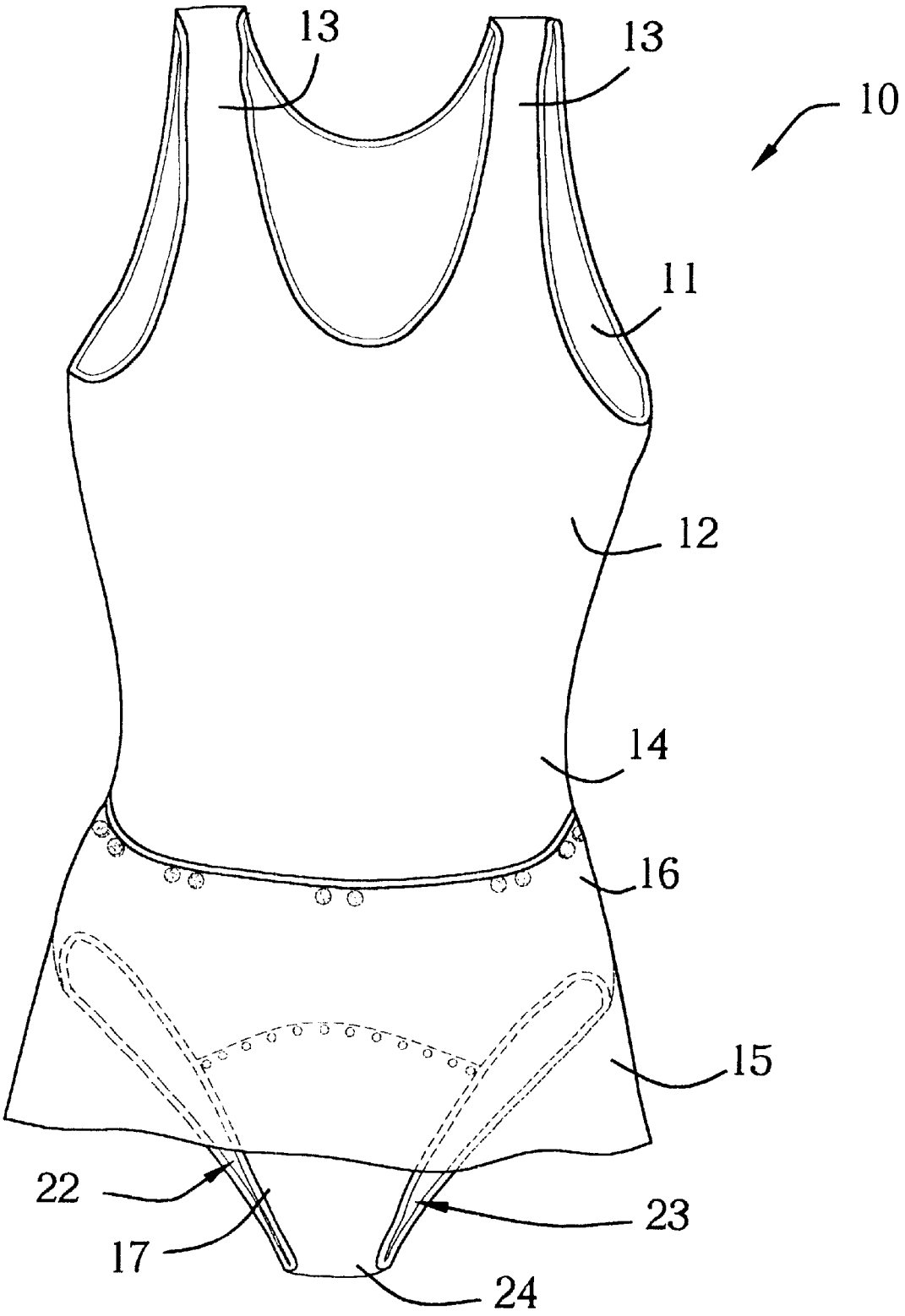
FIG. 2 is a front elevational view of the present invention.
Figure 3:
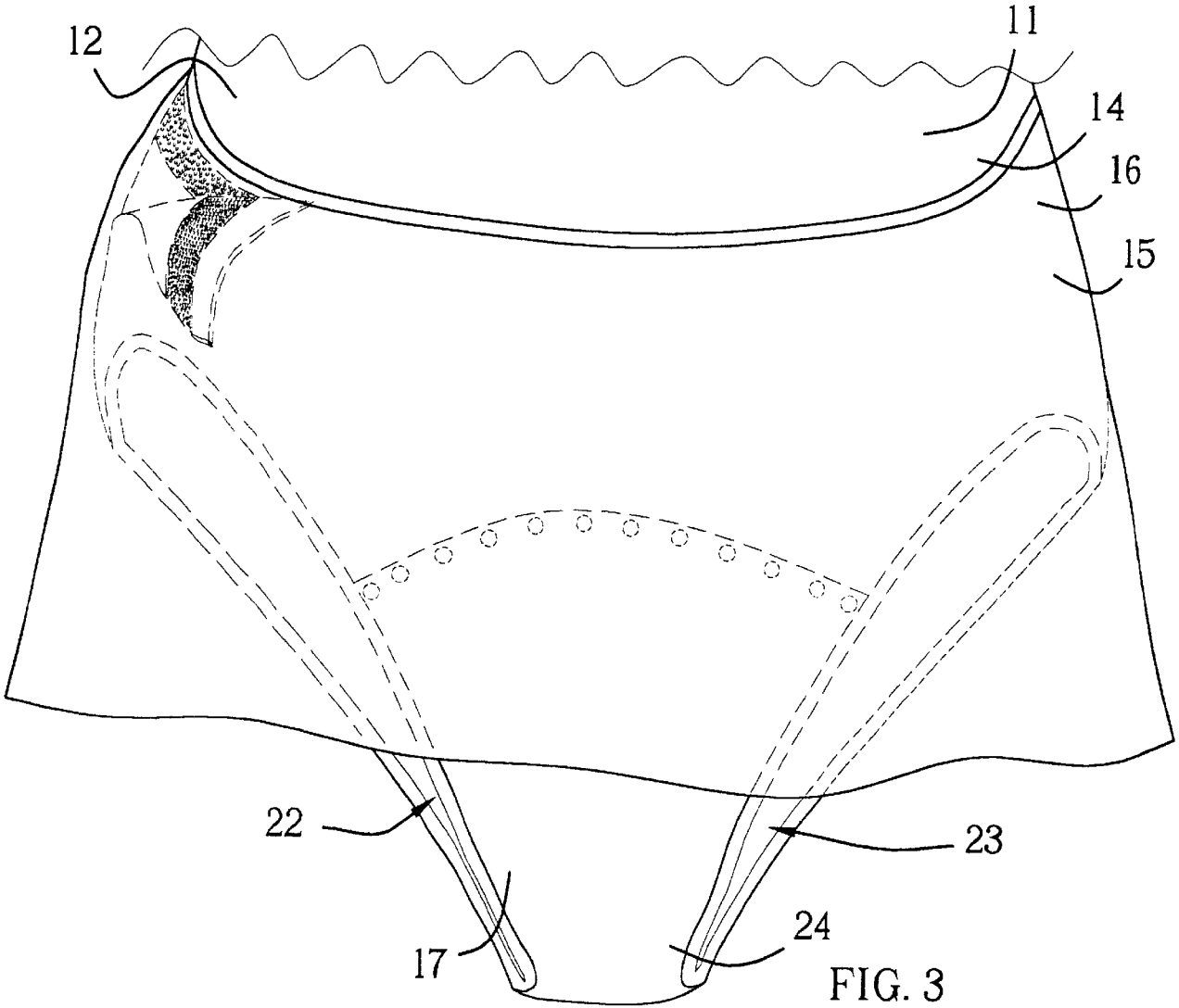
FIG. 3 is a detailed partial front elevational view of the present invention.
Figure 4:
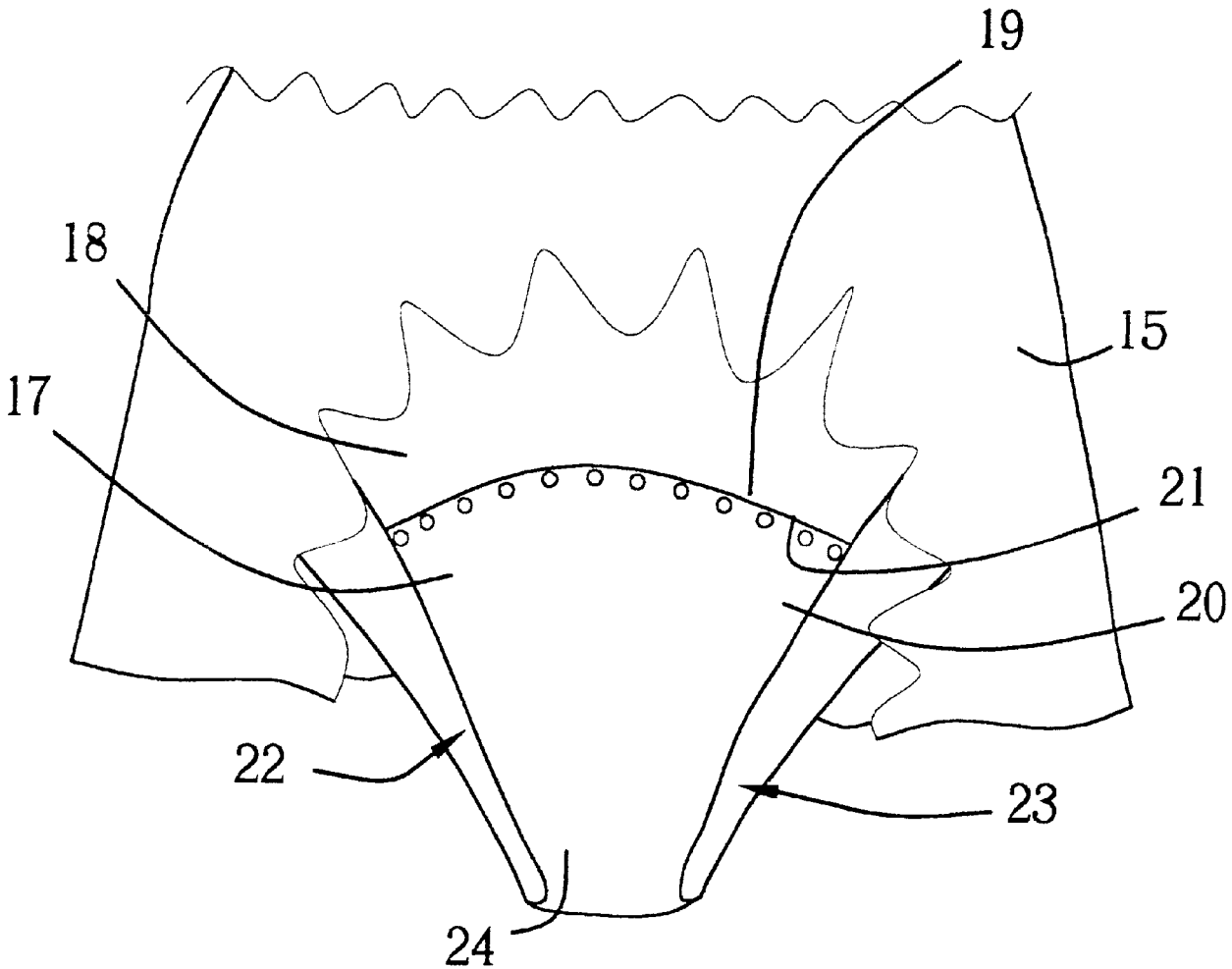
FIG. 4 is a detailed cutaway front elevational view of the present invention.
Figure 5:
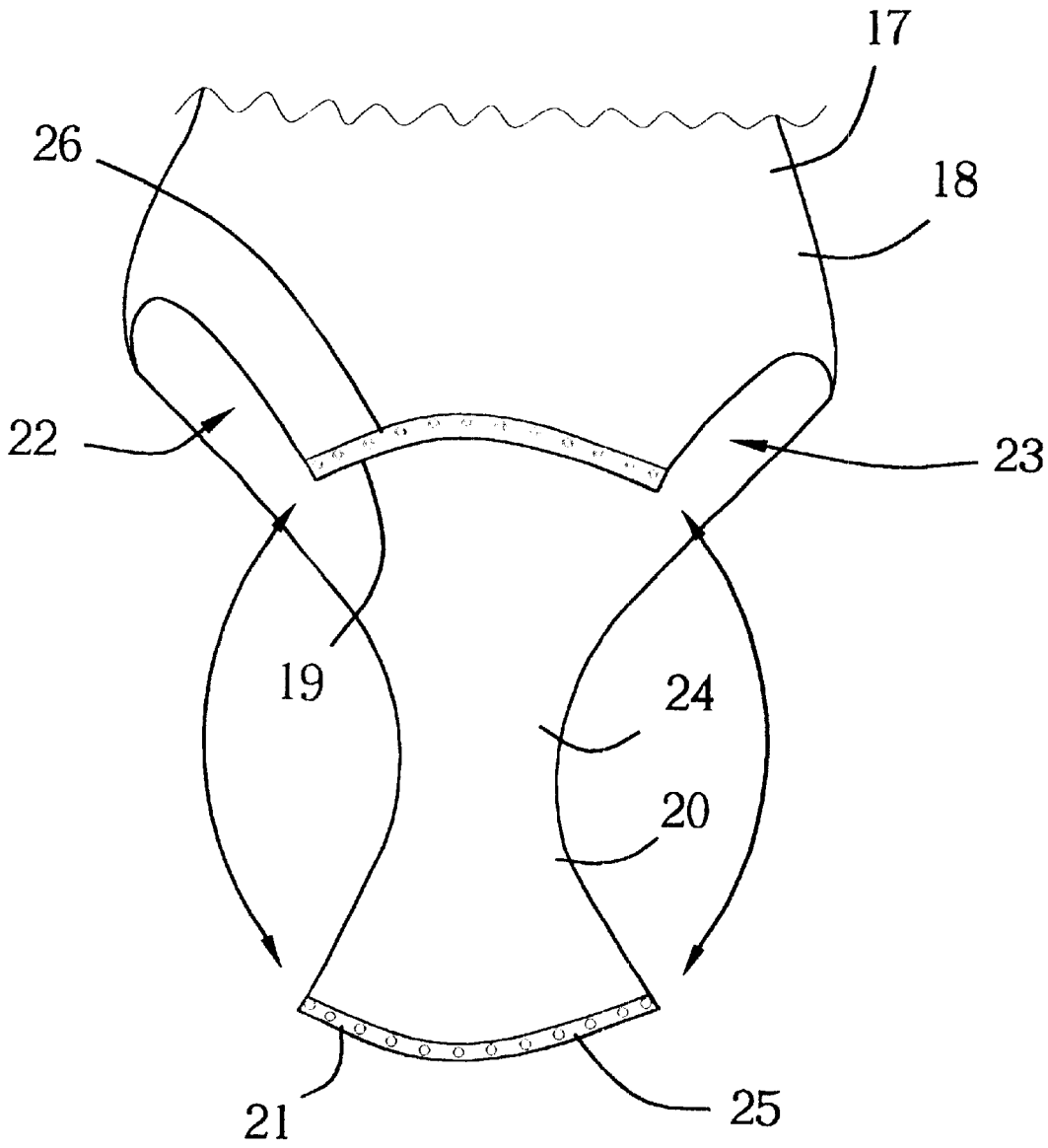
FIG. 5 is another detailed partial front elevational view of the present invention.

With reference now to the drawings, and in particular to FIGS. 1 through 5 thereof, a new swimming apparel embodying the principles and concepts of the present invention and generally designated by the reference numeral 10 will be described.

As best illustrated in FIGS. 1 through 5, the swimming apparel 10 generally comprises a one-piece suit 11 having a tank top member 12, a skirt member 15, and a panty member 17 which has an upper front portion 18 and a lower front portion 20 which is detachably attached to the upper front portion 18. The tank top member 12 includes shoulder straps 13 and also includes a bottom portion 14. The skirt member 15 has a top portion 16 which is securely and conventionally attached to the bottom portion 14 of the tank top member 12. The panty member 17 is integrally attached to the bottom portion 14 of the tank top member 12 and has leg openings 22,23 and a crotch portion 24. The upper front portion 18 has a front bottom edge 19 which extends from one of the leg openings 22 to the other of the leg openings 23, and the lower front portion 20 has a top edge 21 which extends from one of the leg openings 22 to the other of the leg openings 23.

Fastening members 25,26 for fastening the lower front portion to the upper front portion 18 of the panty member 17 include first fastening members 25 being securely and conventionally attached upon an underside of the lower front portion 20 and along the top edge 21 of the lower front portion 20, and also include second fastening members 26 being securely and conventionally attached upon an outerside of the upper front portion 18 and along the bottom edge 19 of the upper front portion 18. The first and second fastening members 25,26 are detachably attached to one another with the first and second fastening members 25,26 including zippers, snap fasteners, buttons, and hook and loop fasteners.

In use, the user unfastens the lower front portion 20 from the upper front portion 18 of the panty member 17 in order to be able to go to the restroom without the user having to completely remove the one-piece suit 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. Swimming apparel comprising:

a suit comprising:

a tank top member; and a panty member having an upper front portion and a lower front portion said lower front portion of said panty member being detachably attached to said upper front portion of said panty member; and first fastening means for fastening said lower front portion to said upper front portion of said panty member;

a skirt member attached to said tank top member above said upper front portion of said panty member to depend downwardly a distance sufficient to position a portion of said skirt member in front of said first fastening means; and second fastening means for removably fastening said skirt member to said tank top member for permitting removal of said skirt member from said tank top member when said lower front portion is detached from said upper front portion.

2. Swimming apparel as described in claim 1, wherein said tank top member includes shoulder straps and also includes a bottom portion.

3. Swimming apparel as described in claim 1, wherein said panty member is integrally attached to said bottom portion of said tank top member and has leg openings and a crotch portion.

4. Swimming apparel as described in claim 3, wherein said upper front portion has a bottom edge which extends from one of said leg openings to the other of said leg openings, and said lower front portion has a top edge which extends from one of said leg openings to the other of said leg openings.

5. Swimming apparel as described in claim 4, wherein said first fastening means includes first fastening members being securely attached upon an underside of said lower front portion and along said top edge of said lower front portion, and also includes second fastening members being securely attached upon an outerside of said upper front portion and along said bottom edge of said upper front portion, said first and second fastening members being detachably attached to one another.

6. Swimming apparel as described in claim 1, wherein said first and second fastening means are selected from the group of fastening means consisting of zippers, snap fasteners, buttons, and hook and loop fasteners.

7. A swimming apparel comprising:

a one-piece suit having a tank top member, a skirt member, and a panty member which has an upper front portion and a lower front portion which is detachably attached to said upper front portion, said tank top member including shoulder straps and also including a bottom portion, said skirt member having a top portion which is securely attached to said bottom portion of said tank top member, said panty member being integrally attached to said bottom portion of said tank top member and has leg openings and a crotch portion, said upper front portion having a bottom edge which extends from one of said leg openings to the other of said leg openings, and said lower front portion has a top edge which extends from one of said leg openings to the other of said leg openings; and fastening members for fastening said lower front portion to said upper front portion of said panty member, said fastening members including first fastening members being securely attached upon an underside of said lower front portion and along said top edge of said lower front portion, and also including second fastening members being securely attached upon an outerside of said upper front portion and along said bottom edge of said upper front portion, said first and second fastening members being detachably attached to one another, said first and second fastening members including zippers, snap fasteners, buttons, and hook and loop fasteners.

8. Swimming apparel comprising:

a suit comprising:

a tank top member; and a panty member having an upper front portion and a lower front portion said lower front portion of said panty member being detachably attached to said upper front portion of said panty member; and first fastening means for fastening said lower front portion to said upper front portion of said panty member;

a skirt member attached to said tank top member above said upper front portion of said panty member to depend downwardly a distance sufficient to position a portion of said skirt member in front of said first fastening means; and second fastening means for removably fastening said skirt member to said tank top member for permitting removal of said skirt member from said tank top member when said lower front portion is detached from said upper front portion;

wherein said tank top member includes shoulder straps and also includes a bottom portion;

wherein said panty member is integrally attached to said bottom portion of said tank top member and has leg openings and a crotch portion;

wherein said upper front portion has a bottom edge which extends from one of said leg openings to the other of said leg openings, and said lower front portion has a top edge which extends from one of said leg openings to the other of said leg openings;

wherein said first fastening means includes first fastening members being securely attached upon an underside of said lower front portion and along said top edge of said lower front portion, and also includes second fastening members being securely attached upon an outerside of said upper front portion and along said bottom edge of said upper front portion, said first and second fastening members being detachably attached to one another; and wherein said first and second fastening means are selected from the group of fastening means consisting of zippers, snap fasteners, buttons, and hook and loop fasteners.

* * * * *